US006880451B2

(12) United States Patent
Beilner et al.

(10) Patent No.: US 6,880,451 B2
(45) Date of Patent: Apr. 19, 2005

(54) OSCILLATING MOTOR

(75) Inventors: Rainer Beilner, Schweinfurt (DE); Matthias Reuss, Stettbach (DE)

(73) Assignee: ZF Sachs AG, Schweinfurt (DE)

( * ) Notice: Subject to any disclaimer, the term of this patent is extended or adjusted under 35 U.S.C. 154(b) by 26 days.

(21) Appl. No.: 10/666,214

(22) Filed: Sep. 19, 2003

(65) Prior Publication Data

US 2004/0134345 A1 Jul. 15, 2004

(30) Foreign Application Priority Data

Sep. 20, 2002 (DE) ..... 102 43 696

(51) Int. Cl.[7] ..... F01C 9/00
(52) U.S. Cl. ..... 92/121; 92/125
(58) Field of Search ..... 92/120, 121, 122, 92/125

(56) References Cited

U.S. PATENT DOCUMENTS

| | | | | |
|---|---|---|---|---|
| 2,781,027 A | | 2/1957 | Henry | |
| 3,053,236 A | * | 9/1962 | Self et al. | 92/125 |
| 4,716,996 A | * | 1/1988 | Hummel | 92/122 |
| 4,825,754 A | * | 5/1989 | Devaud et al. | 92/122 |
| 4,941,554 A | * | 7/1990 | Sollami | 92/125 |
| 5,601,165 A | * | 2/1997 | Oppitz et al. | 92/125 |
| 6,181,034 B1 | * | 1/2001 | Reichel et al. | 92/125 |

FOREIGN PATENT DOCUMENTS

| | | |
|---|---|---|
| DE | 84 36 185 | 3/1985 |
| DE | 43 33 047 | 10/1994 |
| DE | 196 07 067 | 8/1997 |
| DE | 100 62 477 | 7/2002 |

* cited by examiner

*Primary Examiner*—Thomas E. Lazo
(74) *Attorney, Agent, or Firm*—Cohen, Pontani, Lieberman & Pavane

(57) ABSTRACT

An oscillating motor includes a cylinder which is filled with hydraulic medium and which has at least one rib on its inside wall, whereby a motor shaft with at least one vane is supported inside the cylinder with freedom to oscillate, a sleeve concentric to the motor shaft, and a pressure-preloaded sealing arrangement inside each of at least two ring-shaped spaces between the cylinder and the motor shaft, which sealing arrangements seal the working chambers formed by the cylinder and its rib, the motor shaft, and the vane together with the cylinder covers at the ends. The ring-shaped spaces are connected to each other by a pressure equalization channel, and an axial groove, which forms the pressure equalization channel, is present in the contact area between the motor shaft and the sleeve.

9 Claims, 5 Drawing Sheets

OSCILLATING MOTOR

BACKGROUND OF THE INVENTION

1. Field of the Invention

The invention relates to an oscillating motor having a cylinder with inward extending ribs, a motor shaft, outward extending vanes, a pair of cylinder covers surrounding the shaft and forming working chambers between the cylinder and the shaft, and a pressure equalization channel connecting ring shaped spaces having seals.

2. Description of the Related Art

A sealing arrangement of the type used in oscillating motors to seal off the motor shaft against the cylinder of the oscillating motor is known from DE 43 33 047 C1. The seal is intentionally supplied with a working pressure to achieve a dynamic preload. As a result, the advantage is obtained in an oscillating motor that, when there is no pressure in the hydraulic supply system, there is little friction between the motor shaft and the cylinder.

DE 100 62 477 C1 describes taking the pressure for preloading the seal from the working spaces. For this purpose, a groove leading to the ring-shaped space in which the seals are installed is stamped into the cover of the working chamber.

A general problem with pressure-preloaded seals arranged in pairs in an oscillating motor is that the pressure levels at the two seals are different, which means that a longitudinal force is created, which tries to shift the motor shaft with respect to the cylinder. This effect can be minimized, for example, by connecting the pressure-preloaded seals on the motor shaft at the front and rear ends of the working chambers to each other. A design of this type is known from, for example, DE 196 07 067 A1. It is disclosed that longitudinal bores are produced inside the cylinder and the motor shaft to connect the sealing spaces containing the seals to each other. The problem, however, is that a comparatively long bore must be produced.

SUMMARY OF THE INVENTION

The object of the invention is to provide means for equalizing the pressure between the ring-shaped spaces for the seals in such a way that the longitudinal force acting between the motor shaft and the cylinder is minimized.

This object is achieved by providing a sleeve concentric to the motor shaft, and by providing an axial groove, which forms the pressure equalization channel, in the contact area between the motor shaft and the sleeve.

The essential advantage is that the pressure equalization channel can be produced much more easily.

When, for example, the pressure equalization channel is machined into the motor shaft, said pressure equalization channel can be produced very quickly and accurately by a simple milling tool. As an alternative, the pressure equalization channel can be provided in the sleeve. The pressure equalization channel can be produced by a simple groove-clearing operation.

In another advantageous embodiment, the pressure equalization channel has a connection to a working chamber. The advantage of this measure is not only that the pressure levels between the two ring-shaped spaces of the sealing arrangements can be equalized, but also that the pressure can escape into a working space with a much lower pressure level.

It is especially advantageous in this context for the connection to open out into the area of the sealing strip in the vane and for this connection from the sealing strip to the working chamber to be opened as a function of pressure. The sealing strip thus acts in practice as a nonreturn valve. When high pressure is acting on the sealing strip, the connection is closed, but when there is little or no pressure, the connection is opened again.

According to another advantageous construction, the motor shaft has a circumferential recess, which overlaps the ring-shaped space and the pressure equalization channel in the sleeve. The sealing arrangement is designed in such a way that the sealing surfaces are oriented axially in the direction of the vanes of the motor shaft and radially in the direction of the cover of the cylinder. So that the pressure inside the ring-shaped space can be released, it is therefore advisable for the pressure equalization channel to be connected to the rear surfaces of the sealing arrangement.

For the production of a motor shaft, it is generally of interest with respect to simplicity and low production costs for the sleeve to carry the vanes for the motor shaft, because then the sleeve and the vanes can both be produced from a single extruded section, which at least minimizes the need for complicated finishing steps.

In an alternative variant, an axial groove is made inside the vane to receive a sealing strip, which seals the working chamber. According to the invention, the axial groove for the sealing strip is connected to the ring-shaped spaces for the sealing arrangements.

In this variant, there is no need to use a separate sleeve to provide the pressure equalization channel.

In this embodiment, it is helpful for the axial groove to be connected spatially to a second parallel groove, where the sealing strip is supported on a shoulder between the axial groove and the second groove. During the operation of the oscillating motor, the sealing strip is under a very high preload, but because it is supported on the shoulder at the second groove, it cannot "creep" into the second groove. Thus it is possible, for example, for the second groove to be narrower than the axial groove and to extend along the base of the axial groove.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
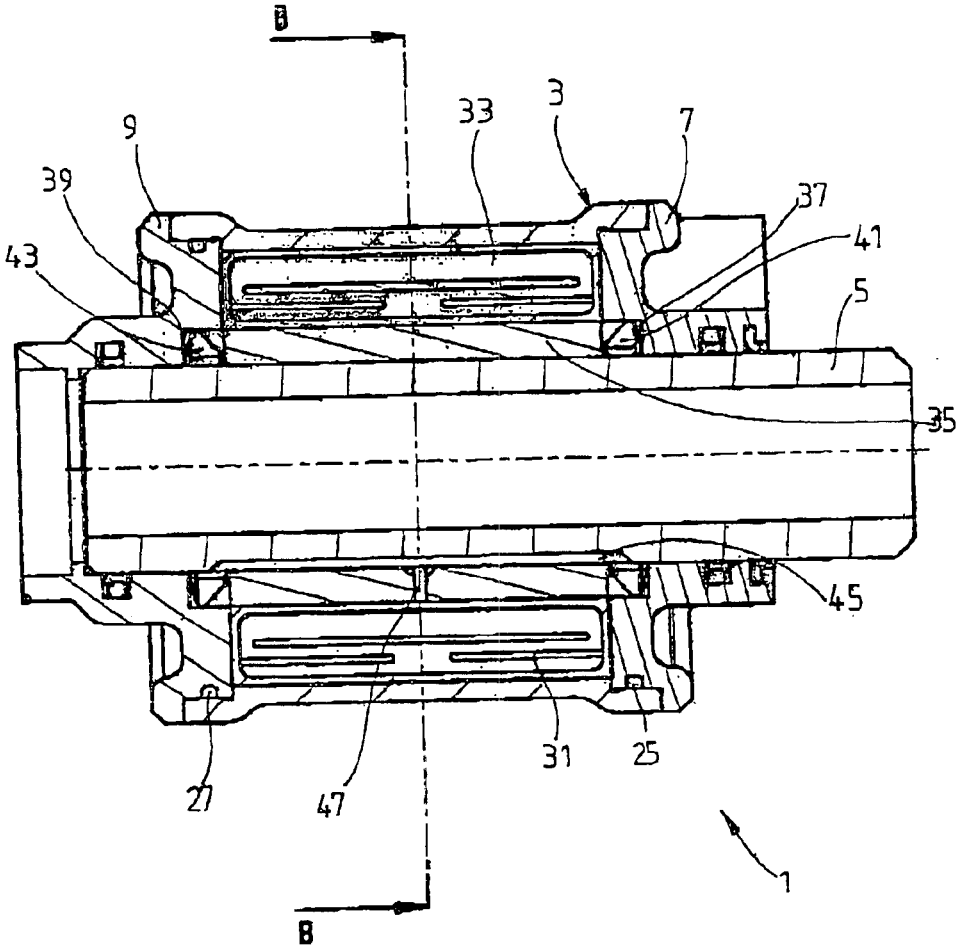
FIG. 1 shows a longitudinal section through an oscillating motor with a pressure equalization channel in the motor shaft.
Figure 2:
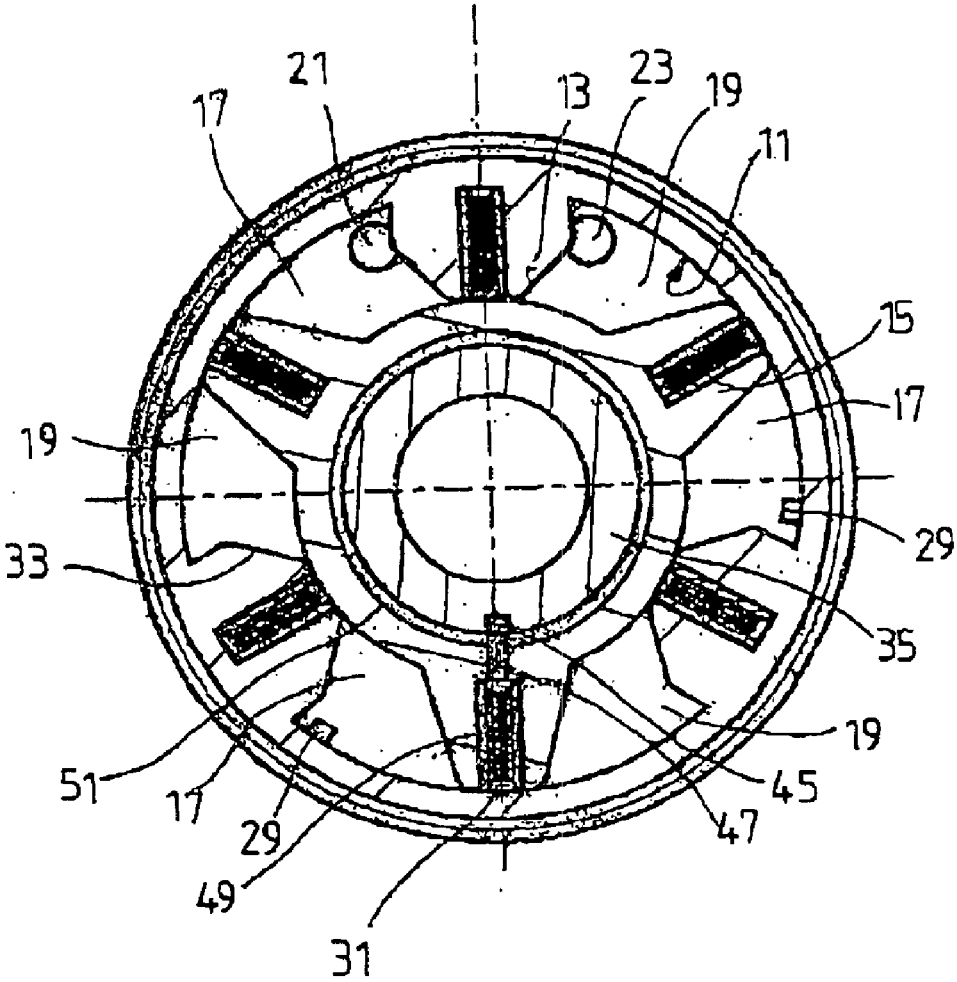
FIG. 2 shows a cross section through the oscillating motor according to FIG. 1.

FIG. 1 shows a longitudinal section through a prime mover in the form of an oscillating motor 1 with a cylinder 3, in which a motor shaft 5 is rotatably supported. Covers 7 and 9 are welded to the ends of the cylinder 3. On the inside wall 11 of the cylinder 3, three ribs 13 (FIG. 2) are provided, which work together with the vanes 15 of the motor shaft 5, the cylinder 3, and the covers 7; 9 to form six working chambers 17; 19, where working chambers with same reference number are connected to each other by a hydraulic medium distribution system. The oscillating motor has two hydraulic connections 21; 23 (FIG. 2). A circumferential groove 25; 27 is machined into each of the two covers 7; 9. Each of these grooves has in turn an axial channel 29 (FIG. 2) leading to the assigned working chamber 17; 19. The number of working chambers depends on the torque to be developed and on the degree to which the oscillating motor can oscillate, which means that the invention is not limited to an oscillating motor with six working chambers.

Inside the vanes and ribs, seals 31; 33 in the form of sealing strips are laid, which separate the adjacent working chambers from each other. The vanes 15 of the motor shaft 5 are a component of a sleeve 35 and are axially and circumferentially connected permanently to the motor shaft 5.

Together with the motor shaft 5 and the sleeve 35, the two covers 7; 9 form ring-shaped spaces 37; 39, which hold sealing arrangements 41; 43 to seal off the working chambers 17; 19. When pressure is acting on a common group of working chambers, such as 17, and there is thus a lower pressure present in the working chambers 19, a very small oil stream is forced into the ring-shaped spaces 37; 39. This reason for this is that, as a result of the different pressures coming from the working chambers, a slight deformation of the sealing arrangement occurs in the circumferential direction, and thus hydraulic medium flows from the working chambers at high pressure into the ring-shaped spaces 37, 39. The volumes of hydraulic medium in question are comparatively very small, but it could happen that, for example, the instantaneous pressure of the medium in the ring-shaped space 37 becomes greater than that in the ring-shaped space 39. So that under no circumstances will there ever by any axially oriented displacing forces acting between the cylinder 3 with its covers 7, 9 and the motor shaft, the two ring-shaped spaces 37; 39 are connected to each other by a pressure equalization channel 45. In the contact area between the inside surface of the sleeve 35 and the outside lateral surface of the motor shaft 5, an axial groove 45 is machined into the motor shaft, the ends of which terminate in the ring-shaped spaces 37; 39. This ensures the complete equalization of the pressures between the ring-shaped spaces 37; 39.

Consideration of FIGS. 1 and 2 together will reveal that the sleeve 35 has a connection 47 to a working space 17; 19. For this purpose, the connection 47 opens out in the area of the axial groove 49 for the sealing strip 31 inside a vane 15, where the sealing strip opens the connection to the working chamber 17; 19 as a function of pressure. So that the sleeve 35 with its connection 47 does not necessarily have to be aligned circumferentially with the pressure equalization channel, a collecting ring 51 can be machined either into the motor shaft or into the sleeve.

Figure 3:
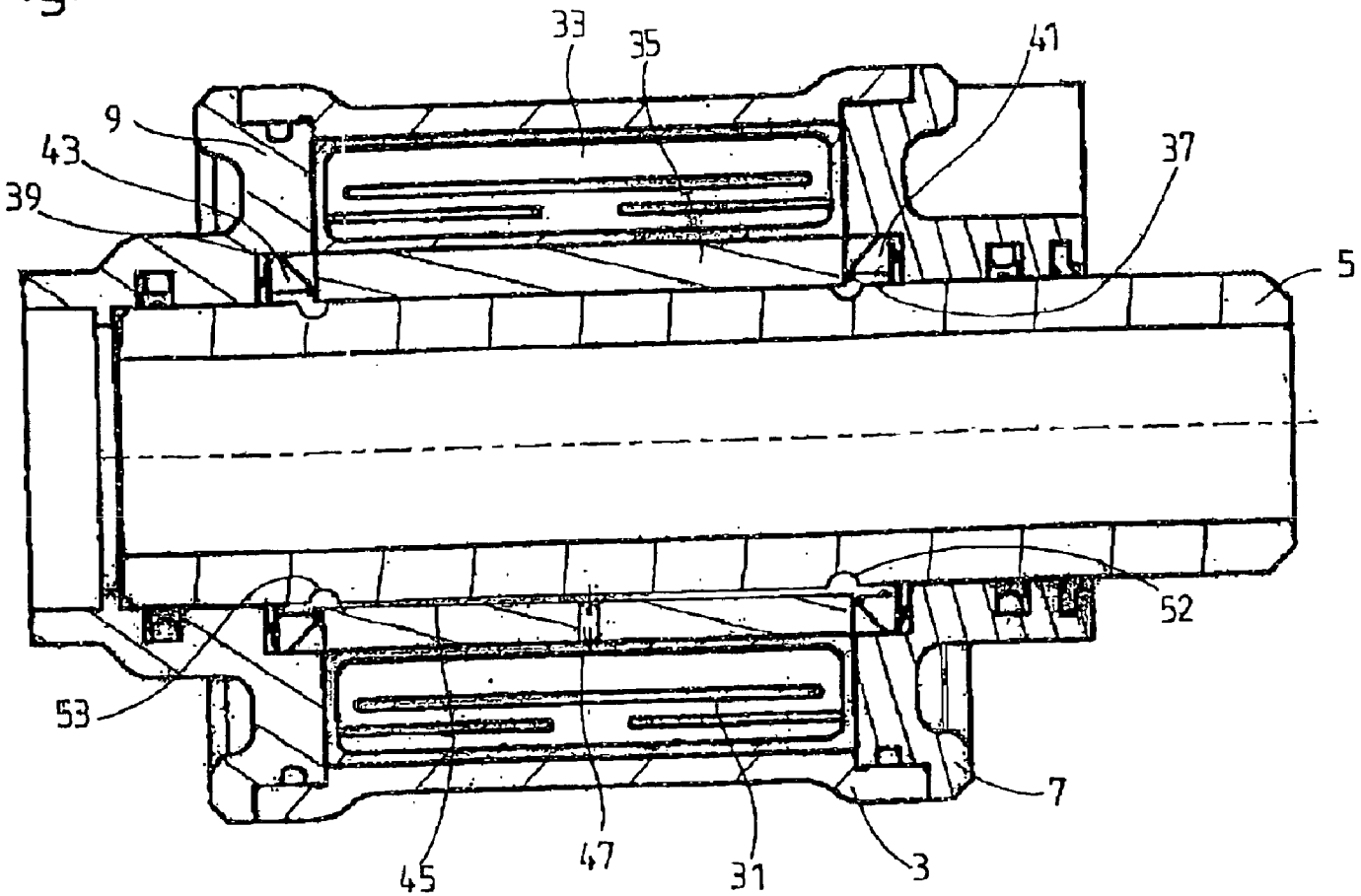
FIG. 3 shows a longitudinal section through an oscillating motor with a pressure equalization channel in the sleeve.

FIG. 3 is intended to show that the pressure equalization channel 45 in the contact area between the sleeve 35 and the motor shaft 5 can also be made inside the sleeve, i.e., in the inside wall of the sleeve 35. The pressure equalization channel 45 again has a connection 47, but it is not needed for the simple pressure equalization between the ring-shaped spaces 37; 39 with the sealing arrangements 41; 43. In addition, circumferential recesses 52; 53 are made in the motor shaft 5, which overlap the ring-shaped spaces 37; 39 and the pressure equalization channel 45. That the connection 47 and the pressure equalization channel 45 are both parts of the same sleeve 35 guarantees that they will be oriented properly with respect to each other upon assembly of the unit.

Figure 4:
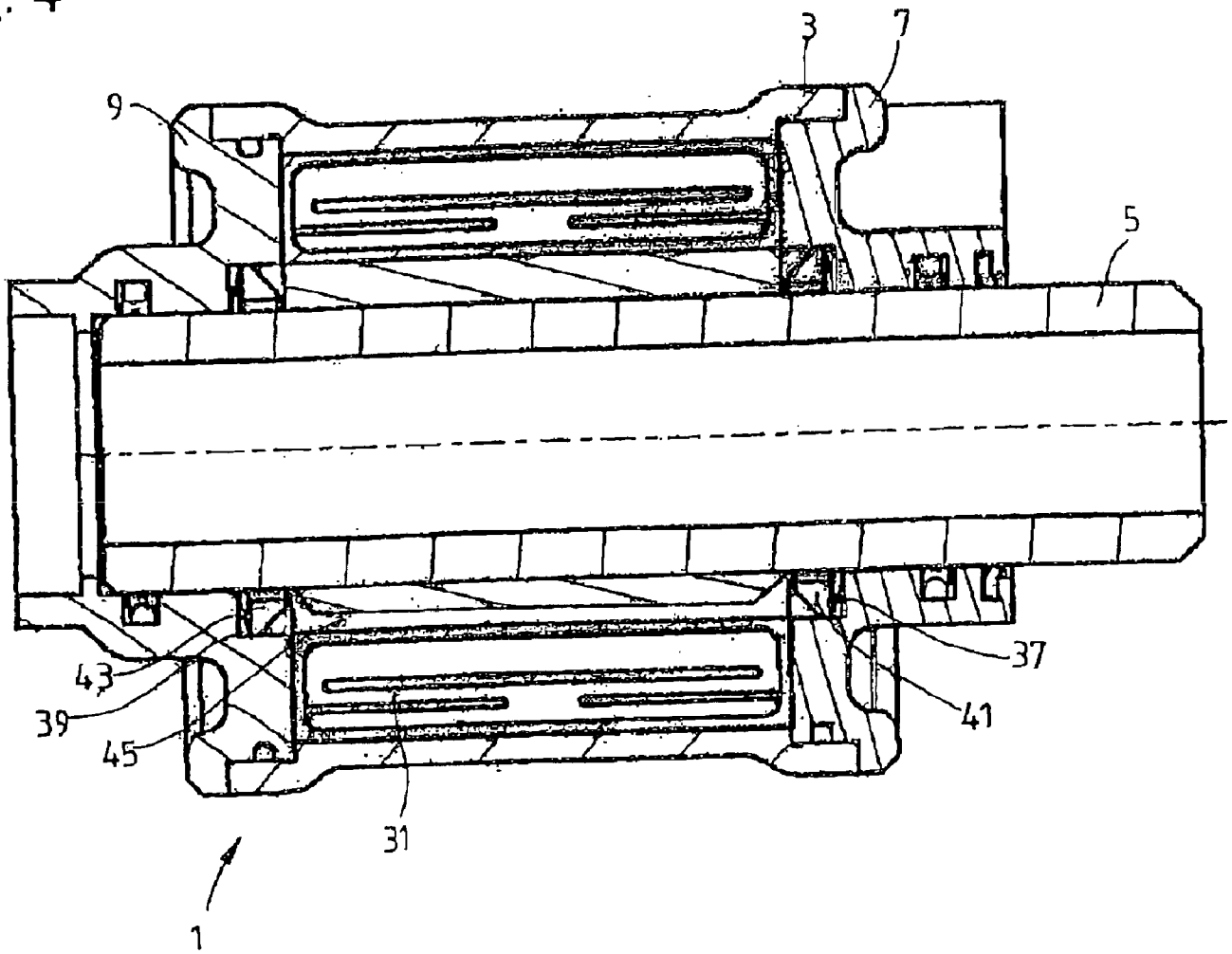
FIG. 4 shows a longitudinal section through an oscillating motor with a pressure equalization channel inside an axial groove for the sealing strip of the vane.
Figure 5:
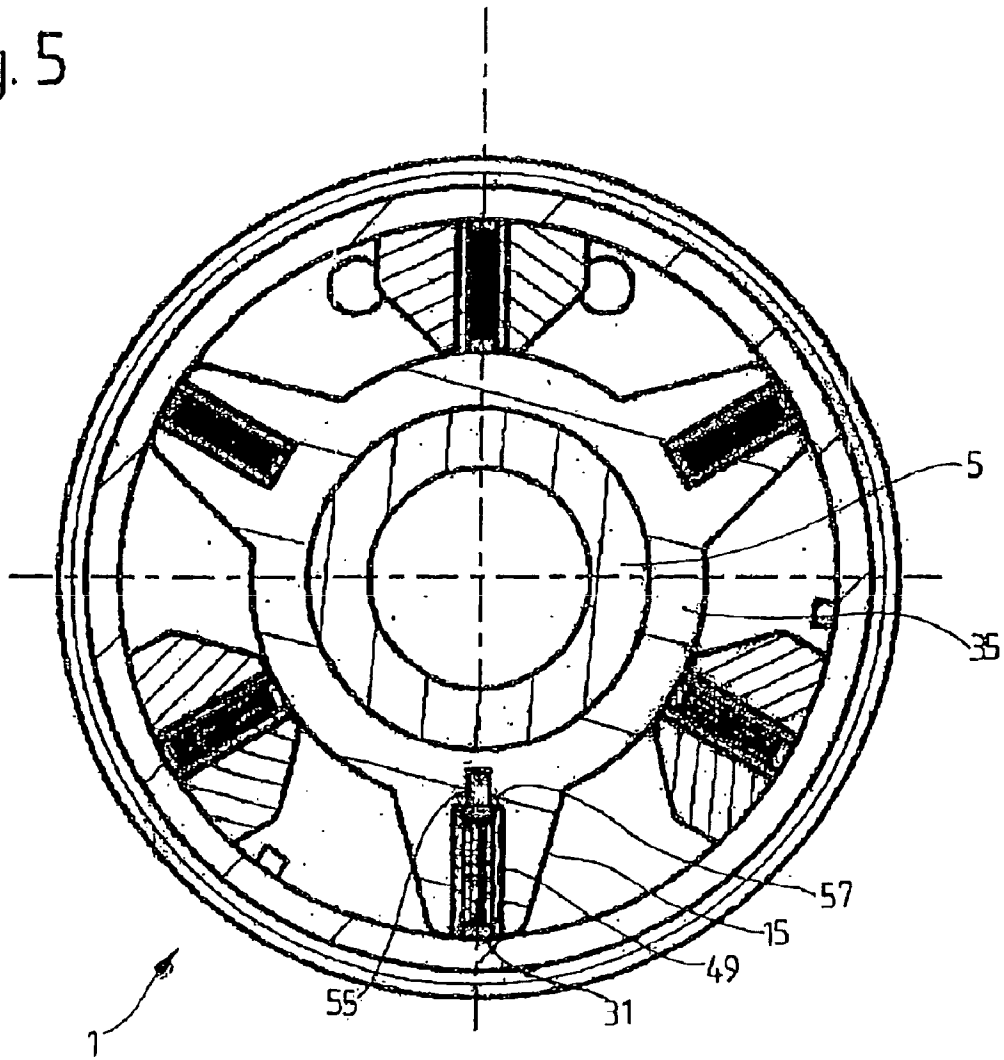
FIG. 5 shows a cross section through the oscillating motor according to FIG. 5.

FIGS. 4 and 5 show an oscillating motor 1 in which the pressure equalization channel 45 can be formed by the axial groove 49 for the sealing strip 31 in the vane 15 of the motor shaft 5, because this axial groove 49 is connected here to the ring-shaped spaces 37; 39 for the sealing arrangements 41; 43. As can be seen in FIG. 5, a second, parallel axial groove 55 is connected radially to the axial groove 49, the cross section of this second groove always being open regardless of the preload on the sealing strip 31, because the sealing strip 31 can be supported on at least one shoulder 57 between the axial groove 49 and the second groove 55.

The invention has been presented on the basis of an oscillating motor, but it can also be used in other prime movers such as torsional vibration dampers.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. An oscillating motor comprising:

a cylinder which can be filled with a hydraulic medium, said cylinder having an inside wall with at least one rib extending radially inward;

a motor shaft supported in said cylinder with freedom to oscillate;

a sleeve concentric to said motor shaft;

at least one vane extending radially outward to said cylinder;

a pair of cylinder covers surrounding said motor shaft and forming working chambers between said cylinder and said sleeve;

a pair of ring-shaped spaces between said motor shaft and said cylinder;

a pair of pressure-preloaded sealing arrangements in respective said ring-shaped spaces sealing off said working chambers; and an axial groove between said motor shaft and said sleeve, said axial groove forming a pressure equalization channel connecting said ring-shaped spaces.

2. An oscillating motor as in claim 1 wherein said pressure equalization channel is machined in said motor shaft.

3. An oscillating motor as in claim 1 wherein said pressure equalization channel is formed in said sleeve.

4. An oscillating motor as in claim 3 wherein said motor shaft comprises a pair of circumferential recesses which overlap respective said ring-shaped spaces.

5. An oscillating motor as in claim 1 further comprising a connection which connects said pressure equalization channel to one of said working chambers.

6. An oscillating motor as in claim 5 wherein each said vane comprises a sealing strip which contacts said cylinder, said connection opening against said sealing strip, said sealing strip opening said connection to a working chamber as a function of pressure.

7. An oscillating motor as in claim 1 wherein said sleeve carries said at least one vane.

8. An oscillating motor comprising:

a cylinder which can be filled with a hydraulic medium, said cylinder having an inside wall with at least one rib extending radially inward;

a motor shaft supported in said cylinder with freedom to oscillate;

at least one vane extending radially outward from said shaft to said cylinder;

a pair of cylinder covers surrounding said motor shaft and forming working chambers between said cylinder and said motor shaft;

a pair of ring-shaped spaces between said motor shaft and said cylinder;

a pair of pressure-preloaded sealing arrangements in respective said ring-shaped spaces sealing off said working chambers; and a first axial groove in each said vane connecting said ring-shaped spaces, said first axial groove receiving a sealing strip which seals off the working chamber.

9. An oscillating motor as in claim 8 further comprising a second axial groove which adjoins said first axial groove at a shoulder in each said vane, said sealing strip being supported on said shoulder.

* * * * *